US007637483B2

(12) United States Patent
Saito

(10) Patent No.: US 7,637,483 B2
(45) Date of Patent: Dec. 29, 2009

(54) CARBURETOR EQUIPPED WITH NEEDLE JET

(75) Inventor: Norio Saito, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 331 days.

(21) Appl. No.: 11/785,848

(22) Filed: Apr. 20, 2007

(65) Prior Publication Data

US 2007/0246846 A1 Oct. 25, 2007

(30) Foreign Application Priority Data

Apr. 25, 2006 (JP) ..... 2006-120930

(51) Int. Cl.
*F02M 9/06* (2006.01)

(52) U.S. Cl. ..... 261/44.3; 261/50.1; 261/51; 261/59; 261/60; 261/DIG. 38

(58) Field of Classification Search ..... 261/44.3, 261/44.4, 44.6, 44.8, 50.1, 50.2, 51, 59, 60, 261/DIG. 38, DIG. 39
See application file for complete search history.

(56) References Cited

U.S. PATENT DOCUMENTS 1,875,557 A * 9/1932 Brown ..... 261/44.3
2,643,865 A * 6/1953 Smith et al. ..... 261/44.3
2,756,033 A * 7/1956 Smith et al. ..... 261/44.3
3,207,491 A * 9/1965 Kingsley et al. ..... 261/44.4
3,460,814 A * 8/1969 O'Neill ..... 261/44.4
3,765,658 A * 10/1973 Hartel et al. ..... 261/41.5
3,829,069 A * 8/1974 Hailstone et al. ..... 261/44.3
3,925,521 A * 12/1975 Otani ..... 261/39.2
3,985,839 A * 10/1976 Edmonston ..... 261/44.3
4,168,685 A * 9/1979 Little et al. ..... 123/575
4,221,747 A * 9/1980 Edmonston ..... 261/44.3
4,290,399 A * 9/1981 Takada et al. ..... 123/439
4,545,350 A * 10/1985 Nakamura et al. ..... 123/439
4,562,012 A * 12/1985 Teramura et al. ..... 261/44.4
4,793,950 A * 12/1988 Hedlund ..... 261/4
4,971,730 A * 11/1990 Edmonston ..... 261/44.3
5,480,592 A * 1/1996 Morrow ..... 261/44.4
5,648,023 A * 7/1997 Nojima ..... 261/44.4
5,988,602 A * 11/1999 Yokoyama et al. ..... 261/35

(Continued)

FOREIGN PATENT DOCUMENTS

JP 58-170841 A * 10/1983 ..... 261/44.4

(Continued)

*Primary Examiner*—Richard L Chiesa
(74) *Attorney, Agent, or Firm*—Birch, Stewart, Kolasch & Birch, LLP

(57) ABSTRACT

A carburetor includes a valve mechanism, and a needle jet extending in an up and down direction. Also included is a jet needle provided to a sliding throttle valve disposed in an air intake tube and inserted into the jet needle. The valve mechanism includes a valve body, which has a plate shape and which is moved by the flow of the fuel. When a motorcycle lands on the ground after the motorcycle jumps while running, the fuel-in-jet, that is, the fuel in the needle jet, tends to accelerate downwardly. The valve mechanism prevents a downward reverse flow of the fuel-in-jet on which such downward acceleration acts. The resulting configuration prevents temporary production of a lean air-fuel mixture, which may possibly be produced when the fuel in the needle jet has accelerated downwardly.

20 Claims, 4 Drawing Sheets

U.S. PATENT DOCUMENTS

| | | | | |
|---|---|---|---|---|
| 7,513,487 | B2 * | 4/2009 | Saito | 261/44.3 |
| 2002/0113326 | A1 * | 8/2002 | Takano et al. | 261/39.2 |
| 2004/0130040 | A1 * | 7/2004 | Araki | 261/34.2 |
| 2007/0120274 | A1 * | 5/2007 | Saito | 261/44.3 |

FOREIGN PATENT DOCUMENTS

| | | | | |
|---|---|---|---|---|
| JP | 61-81565 A | * | 4/1986 | 261/44.3 |
| JP | 10-26053 A | | 1/1998 | |

* cited by examiner

CARBURETOR EQUIPPED WITH NEEDLE JET

CROSS-REFERENCE TO RELATED APPLICATION

The present application claims priority under 35 U.S.C. §119 to Japanese Patent Application No. 2006-120930, filed Apr. 25, 2006, the entire contents of which are hereby incorporated by reference.

BACKGROUND OF THE INVENTION

1. Field of the Invention

The present invention relates to a carburetor in which a jet needle inserted into a needle jet controls the amount of fuel supply. An internal combustion engine mounted on a motorcycle is equipped with the type of carburetor.

2. Description of Background Art

A type of carburetor that has been known as one for internal combustion engine of motorcycle is equipped with a needle jet and a jet needle. In this type of carburetor, the needle jet is disposed as extending in the up and down directions, and the fuel is supplied to the air intake tube through the upper end portion of the needle jet. Meanwhile, the jet needle, which is inserted into the needle jet, is provided to the throttle valve. For details, refer to Japanese Patent Application Laid-Open Publication No. Hei 10-26053.

Some motorcycles, such as off-road motorcycles, run with occasional big jumps. In a carburetor of the engine mounted on a motorcycle of this kind, an inertial force acts on the fuel inside the needle jet (hereinbelow referred to as "fuel-in-jet") at the time of landing after a jump, and the fuel-in-jet is accelerating downward. A large acceleration of this direction makes the fuel-in-jet move downward. The fuel-in-jet sometimes flows out of the needle jet, then passes through the main fuel jet, and then flows back to the float chamber. With such a reverse flow, the fuel-in-jet lessens, which temporarily reduces the fuel delivery from the needle jet to the air intake tube. The lean air-fuel mixture thus produced reduces the engine output.

The present invention has been made in view of the problem mentioned above. An object of the present invention is to prevent the carburetor equipped with a needle jet from producing a lean air-fuel mixture that may possibly be produced, though temporarily, when the fuel in the needle jet is accelerating downward.

SUMMARY AND OBJECTS OF THE INVENTION

A first aspect of the present invention provides a carburetor in which a needle jet is disposed as extending in the up and down directions. Through an upper end portion of the needle jet, the fuel in a fuel chamber is supplied to an air intake tube. A throttle valve is disposed in the air intake tube and a jet needle provided to the throttle valve is inserted into the needle jet. The jet needle works in conjunction with the opening-and-closing action of the throttle valve to control the amount of fuel to be supplied to the air intake tube. The carburetor also includes a valve mechanism. When downward acceleration acts on the fuel-in-jet, that is, the fuel in the needle jet, a downward reverse flow of the fuel-in-jet is caused by such downward acceleration. The valve mechanism prevents such a reverse flow.

A second aspect of the present invention provides the carburetor of the first aspect with such additional features as follows. The valve mechanism includes a plate-shaped valve body that is moved by the flow of the fuel. The valve mechanism also includes an upper valve seat which is disposed immediately above the valve body, and in which a protrusion is formed so that the valve body can be seated on the protrusion. Moreover, the valve body includes a lower valve seat which is disposed immediately below the valve body, and on which the valve body can be seated. When the fuel is supplied from the fuel chamber to the air intake tube, the valve body is seated on the protrusion to prevent the valve body from adhering to the upper valve seat. On the other hand, when the acceleration acts on the fuel-in-jet, the valve body is seated on the lower valve seat and the valve body prevents the downward reverse flow of the fuel-in-jet.

A third aspect of the invention provides the carburetor of the second aspect with such additional features as follows. The upper valve seat and the lower valve seat form a fuel retention chamber in which the valve body is housed. The fuel retention chamber includes an annular chamber surrounding the upper valve seat.

A fourth aspect of the invention provides the carburetor of the first aspect with such additional features as follows. The valve mechanism includes a valve holder that is screwed to be fixed to the needle jet. A main fuel jet is screwed to be fixed to the valve holder. The screw-fixation portion of the valve holder to the needle jet has the same structure as the screw-fixation portion of the main fuel jet.

EFFECTS OF THE INVENTION

According to the first aspect, the production of a lean air-fuel mixture that may possibly be produced temporarily is prevented when a vehicle equipped with such an internal combustion engine including the carburetor jumps and lands on the ground. At that moment, downward acceleration acts on the fuel-in-jet, resulting in a downward reverse flow of the fuel-in-jet, which the valve-mechanism prevents. As a result, even under the downward acceleration, the fuel-in-jet is supplied to the air intake tube, and thus the production of the lean air-fuel mixture is prevented.

According to the second aspect, the valve mechanism prevents, more effectively, the production of the lean air-fuel mixture. The valve body has a plate-like shape, which facilitates the movement of the valve body caused by the flow of the fuel. Accordingly, a subtle downward flow of the fuel-in-jet, which takes place when the downward acceleration acts on the fuel-in-jet, causes the valve body to be seated on the lower valve seat. In addition, the valve body has such a structure including the protrusion that the valve body and the upper valve seat cannot adhere to each other so easily. As a result, the reverse flow of the fuel-in-jet is prevented quickly, resulting in a more effective prevention of the lean-air-fuel-mixture production by the valve mechanism.

According to the third aspect, the valve mechanism prevents, more effectively, the production of a lean air-fuel mixture. The fuel retention chamber retains an extra amount of fuel—the amount equivalent to the capacity of the annular chamber. While the valve body is seated on the lower valve seat, the valve mechanism is in the closed-valve state. Even in the case of the closed-valve state continuing for a little longer time, the fuel in the fuel retention chamber is supplied to the needle jet. As a result, no fuel shortage occurs even when the valve mechanism is in the closed-valve state, resulting in a more effective prevention of the lean-air-fuel-mixture production by the valve mechanism.

According to the fourth aspect, existing carburetors can be used for the present invention. This is because, to an existing carburetor in which the needle jet is screwed to be fixed to the main fuel jet, the valve mechanism can be added by screwing to fix the valve holder to the needle jet.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
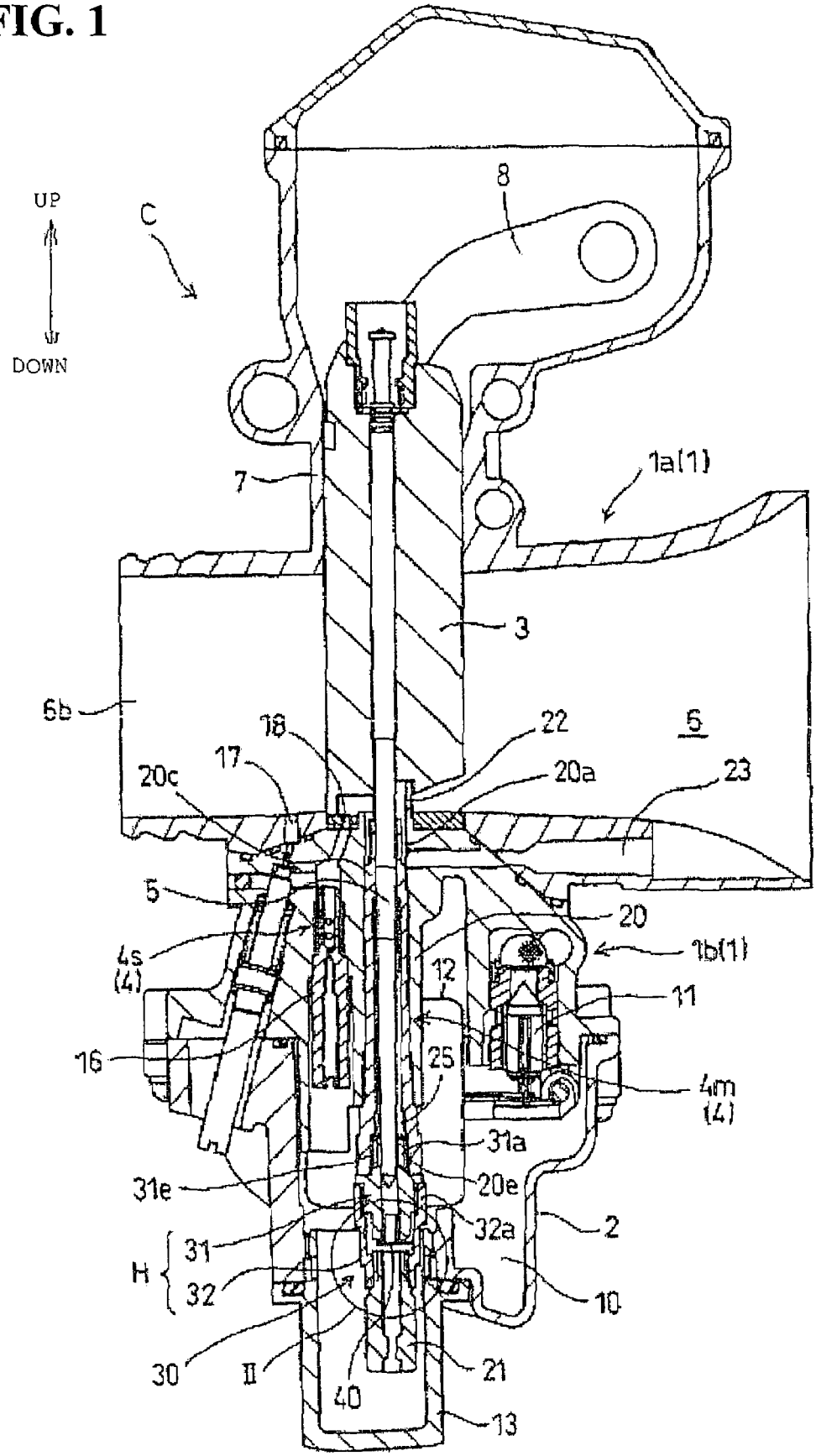
FIG. 1 is a cross-sectional view of the main part of a carburetor to which the present invention is applied, according to a first embodiment of the present invention.
Figure 2A:
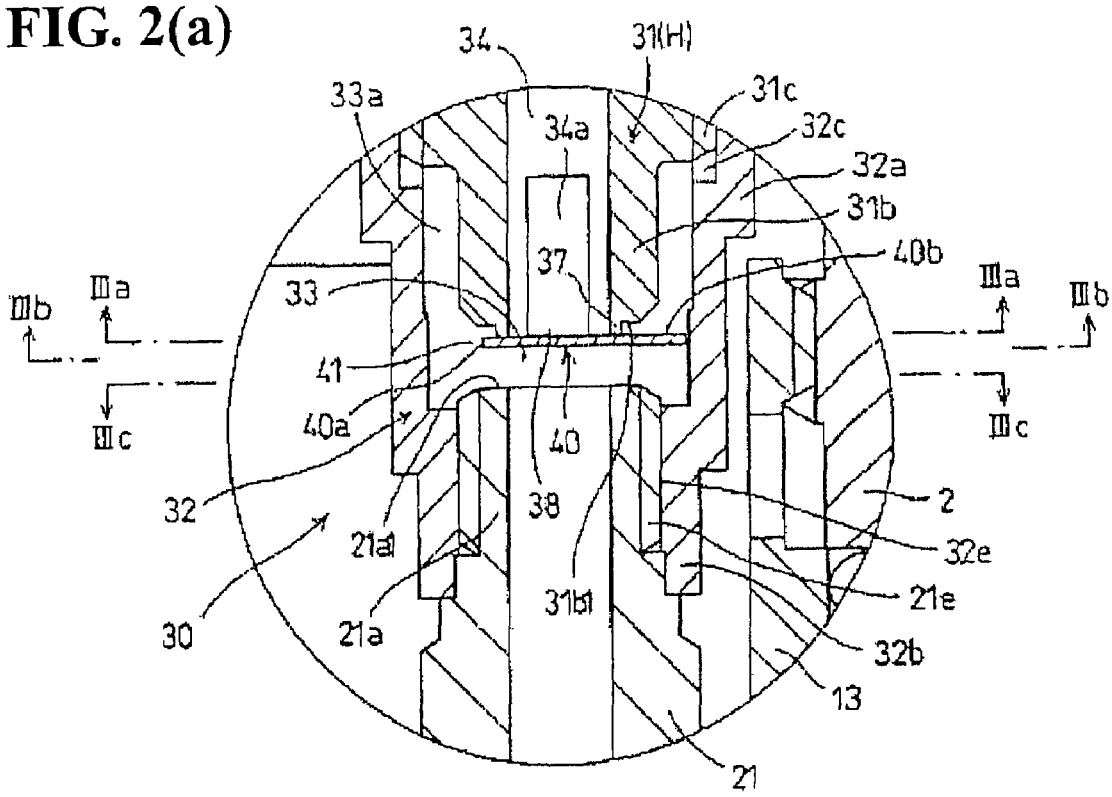
FIG. 2A is an enlarged view of a part indicated as II in FIG. 1, and the view shows an open-valve state of a valve mechanism.
Figure 2B:
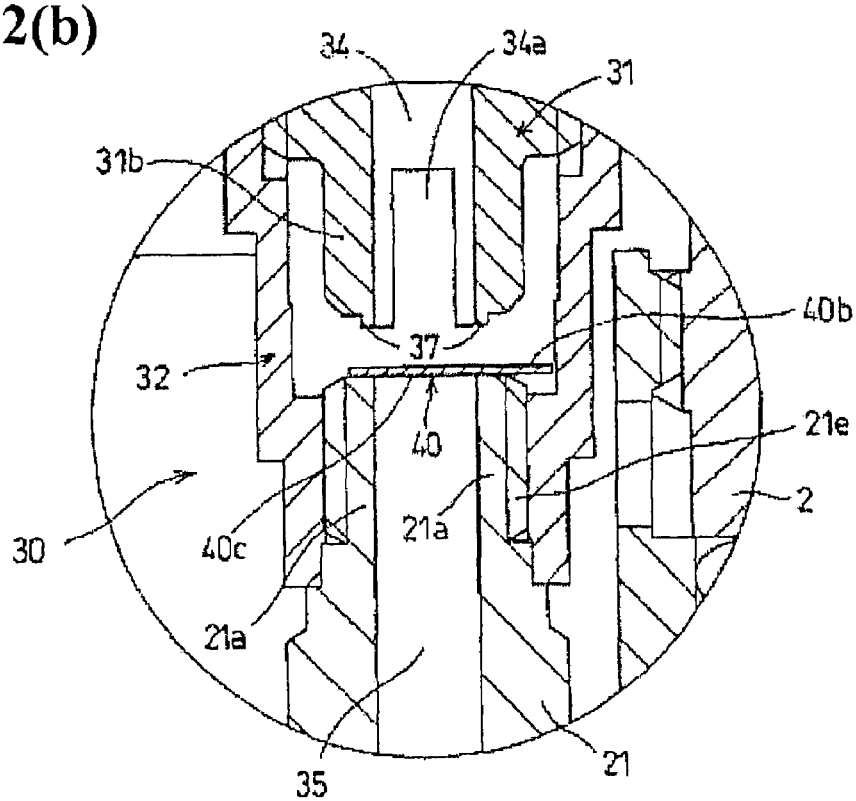
FIG. 2B shows a closed-valve state of the valve mechanism.
Figure 3A:
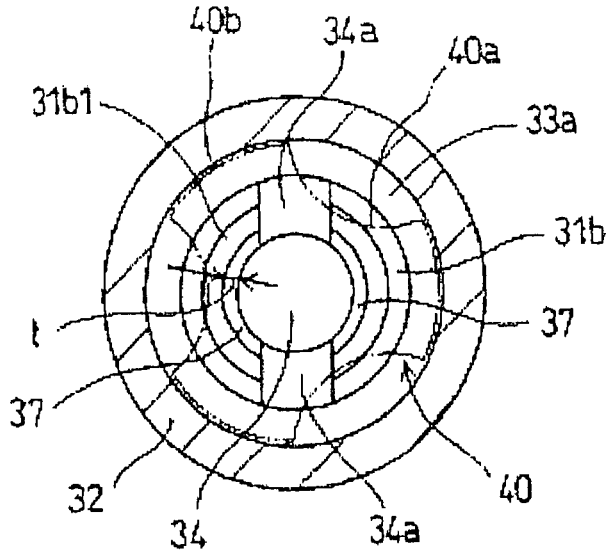
FIG. 3A is a cross-sectional view taken along a line IIIa-IIIa in the FIG. 2A.
Figure 3B:
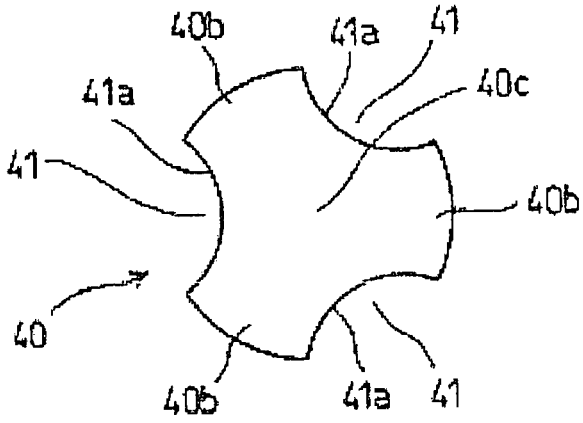
FIG. 3B is a view seen from a direction as indicated by an arrow IIIb-IIIb in FIG. 2A.
Figure 3C:
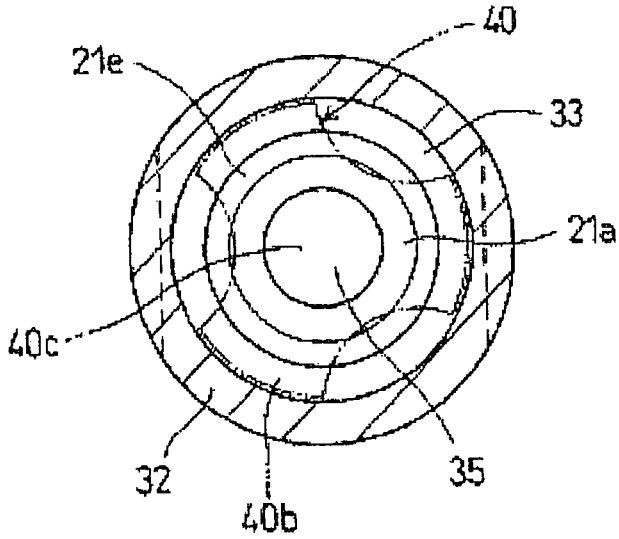
FIG. 3C is a cross-sectional view taken along a line IIIc-IIIc in FIG. 2A.

FIG. 1 to FIG. 3 are views for describing a first embodiment of the present invention.

FIG. 1 shows a sliding throttle valve type carburetor C, a carburetor to which the present invention is applied. An internal combustion engine equipped with the carburetor C is mounted on a small vehicle such as a motorcycle including an off-road type one. The carburetor C includes a carburetor body 1 provided with an air intake tube 6, where intake air circulates. The carburetor C also includes a float-chamber body 2 as a fuel-chamber body provided at the bottom part of the carburetor body 1. The float chamber body 2 forms a float chamber 10 as a fuel chamber. Also included are: a throttle valve 3, which is disposed in the air intake tube 6, and which controls the flow of intake air supplied to the engine; a fuel system 4, which introduces the fuel in the float chamber 10 to the air intake tube 6; and a jet needle 5, which is provided to the throttle valve 3, and which works in conjunction with the opening-and-closing movement of the throttle valve 3 to control the amount of fuel supplied to the air intake tube 6.

The carburetor body 1 includes an air intake-system formed section 1*a* as well as a fuel system formed section 1*b* joined to and integrated into the bottom of the air intake-system formed section 1*a*. The air intake tube 6 and a guiding section 7 are formed in the air intake-system formed section 1*a*. The air intake tube 6 is the place where the intake air flown, through the air cleaner, into the air intake tube 6 and the fuel supplied from the fuel system 4 are blended to produce an air-fuel mixture. While the throttle valve 3 reciprocally travels as cutting across the air intake tube 6, the guiding section 7 guides the reciprocating movement of the throttle valve 3. The air-fuel mixture, let out from a downstream end 6*b* of the air intake tube 6, passes through the intake passage which the intake pipe and the like constitute. The air-fuel mixture is eventually taken into combustion chamber of the internal combustion engine.

The throttle valve 3 is a sliding valve that is slidably guided by the guiding section 7. The throttle valve 3 links with a control lever 8, which is controlled as swinging when the driver operates the accelerator controlling member. As the accelerator controlling means controls the throttle valve 3 with the control lever 8, the throttle valve 3 travels reciprocating up and down. The reciprocating movement is an opening-and-closing movement for the air intake tube 6, and the air intake tube 6 opens and shuts within an opening degree range from the idling opening degree to the full throttle. The intake air flowing through the air intake tube 6 is controlled in this way.

The float chamber 10 is formed by joining the float chamber body 2 to the fuel-system formed section 1*b*. The fuel retained in the float chamber 10 forms a liquid surface of a certain level defined by a float 12 that opens and closes a fuel-inflow-control valve 11. The fuel in the float chamber 10 is supplied to the air intake tube 6 through the fuel system 4 by a negative pressure generated in the air intake tube 6 in accordance with the opening degree of the throttle valve 3. A drain plug 13, which is a member in a shape of tube with a bottom, is screwed up to the bottom of the float chamber body 2.

The fuel system 4 is provided to the fuel-system formed section 1*b*, which is located under the air intake tube 6 and extends down to the underneath of the liquid surface of the fuel in the float chamber 10. A slow-speed fuel system 4*s* and a main fuel system 4*m* constitute the fuel system 4. A slow fuel jet 16, an idle port 17, a by-pass port 18 constitute the slow-speed fuel system 4*s*. Meanwhile the main fuel system 4*m* includes a needle jet 20 into which the jet needle 5 attached to the throttle valve 3 is inserted. The main fuel system also includes a main fuel jet 21 that meters the amount of fuel flowing into the needle jet 20. The fuel is supplied to the air intake tube 6 mainly through the slow-speed fuel system 4*s* with the throttle valve 3 being in the range of small opening degree, that is, while the internal combustion engine is operating at an idling speed or is operating with a light load. Meanwhile the fuel is supplied to the air intake tube 6 mainly through the main fuel system 4*m* with the throttle valve 3 being in the range of large opening degree, that is, while the internal combustion engine is operating with a heavy load. At this time, the fuel supplied to the air intake tube 6 is metered by the jet needle 5.

The main fuel pipe, that is the needle jet 20, is disposed as extending linearly in the up and down directions, and is screwed to be fixed to the fuel-system formed section 1*b*. The fuel, which comes from the float chamber 10 passing through the main fuel jet 21, is supplied to the air intake tube 6 through an upper end portion 20*a* of the needle jet 20. The upper end portion 20*a* is disposed inside a main nozzle 22, which is formed at an upper end portion of the fuel-system formed section 1*b*, and which protrudes inside the air intake tube 6. The fuel injected from the upper end portion 20*a* is supplied to the air intake tube 6 after the fuel is atomized, in the main nozzle 22, by the bleed air coming from a bleed air passage 23.

The needle jet 20 includes a metering portion 20*c* into which the jet needle 5 is inserted. The jet needle 5 and the metering portion 20*c* combined together form a cross section area, and the area is changed by the position of the jet needle 5 in accordance with the opening degree of the throttle valve 3. With the change, the amount of fuel corresponding to the intake air flow is supplied from the needle jet 20, and thus the output of the internal combustion engine is controlled.

Incidentally, when a running motorcycle, an off-road type motorcycle in particular, makes a relatively big jump and then lands on the ground, the fuel inside the needle jet 20, that is, the fuel-in-jet, is accelerating downward (hereinbelow, the force acting on the fuel is referred to as "downward acceleration"). The downward acceleration sometimes makes the fuel-in-jet move downward and flow out of the needle jet 20. The fuel thus flown out may possibly be flown back to the float chamber 10 through the main fuel jet 21. This reverse flow makes the air-fuel mixture lean temporarily. For the purpose of preventing the lean air-fuel mixture from being produced in this way, a valve mechanism 30 is provided to the carburetor C. The valve mechanism 30 checks the downward reverse flow of the fuel-in-jet, which may take place when the downward acceleration acts on the fuel-in-jet.

Now, refer to FIG. 1 to FIG. 3. The valve mechanism 30 is provided to the fuel system, along the way from the main fuel jet 21 to the needle jet 20 and is placed as dipped in the fuel in the float chamber 10. The valve mechanism 30 of this embodiment includes a valve holder H, which is screwed to be joined to the needle jet 20, and a valve body 40, which is housed in the valve holder H and moves as the fuel flows. Also included is the main fuel jet 21, which is screwed to be joined to the valve holder H.

An upper holder 31 and a lower holder 32 constitute the valve holder H. The upper holder 31 is joined to a female-threaded portion 20*e*, which is formed in a bottom portion of the needle jet 20, and which is a portion for screw fixation. The lower holder 32 is screwed to be detachably joined to the upper holder 31. A space is formed by joining together the upper holder 31, the lower holder 32 and the main fuel jet 21. Part of the space constitutes a fuel retention chamber 33. Precisely, it is the part located on a downstream side of the fuel flow from the valve body 40 in a state where the valve of the valve mechanism 30 is closed.

The cylindrical upper holder 31 is disposed immediately above the valve body 40. Formed in the upper holder 31 is an over-valve passage 34, extending in the up and down directions and communicating to a fuel passage 25 inside the needle jet 20. In addition, formed in an upper end portion 31*a* of the upper holder 31 is a male threaded portion 31*e*, as a screw-fixation portion to be screwed into the female-threaded portion 20*e*. Moreover, formed at a bottom end portion 31*b* of the upper holder 31 are: a protrusion 37 where the valve body can be seated; and a pair of fuel entrances 34*a* through which the fuel that has passed through the main fuel jet 21 is led to the over-valve passage 34. Furthermore, formed between the upper end portion 31*a* and the lower end portion 31*b* is a male threaded portion 31*c* to which the lower holder 32 is joined.

The protrusion 37 is formed in a lower end surface 31*b*1 of the lower end portion 31*b*. The protrusion 37 is an open-valve seat portion that the valve body 40 is seated on when the fuel is supplied to the air intake tube 6 from the float chamber 10. The protrusion 37 protrudes downward in a position facing, in the up and down directions, an upper end portion 21*a* of the main fuel jet 21. The protrusion 37 is composed of a pair of arc-shaped ridges that an annular ridge interrupted by fuel entrances 34*a* is formed into. For the purpose of preventing the valve body 40 from adhering to the lower end portion 31*b*, the protrusion 37 has a shape such that the contact area with the valve body 40 can be as small as possible. For this reason, a width t in the radial direction of the protrusion 37 is approximately equal to the thickness of the valve body 40, and, as a result, the valve body has a smaller contact area with the lower end portion 31*b* than that with the upper end portion 21*a*. In a state where the valve body 40 is seated on the protrusion 37, the protrusion 37, which serves as adherence prevention means, forms a gap 38 between the valve body 40 and the lower end portion 31*b*. Through the gap 38, the fuel flows into the over-valve passage 34 in that state. Part of each fuel entrance 34*a* constitutes the gap 38 in this embodiment. Thanks to the fuel flow through the gap 38, the gap 38 also contributes to the prevention of the adherence of the valve body 40.

The cylindrical lower holder 32 has a female-threaded portion 32*c* formed in the upper end portion 32*a* and screwed onto the male-threaded portion 31*c* of the upper holder 31. The cylindrical lower holder 32 also has a female-threaded portion 32*e* formed in the lower end portion 32*b*, which is a screw-fixation portion into which a screw-fixation portion of the main fuel jet 21, that is, the male-threaded portion 21*e*, is screwed. The main fuel jet is disposed immediately below the valve body 40. The upper end portion 21*a* of the main fuel jet 21 faces the fuel retention chamber 33, and constitutes close-valve seat portion. The valve body 40 can be seated on an upper end surface 21*a*1 of the upper end portion 21*a*. The passage for the fuel formed inside the main fuel jet 21 constitutes the under-valve passage 35 of the valve mechanism 30.

As has been described above, the upper holder 31 and the main fuel jet 21 constitute the upper valve seat and the lower valve seat, respectively. The over-valve passage 34 and the under-valve passage 35 are positioned with the valve body 40 and a part of the fuel retention chamber 33 placed in between. There, the over-valve passage 34 and the under-valve passage 35, together with the fuel passage 25 of the needle jet 20, are arranged to form a straight line. Additionally, in the valve mechanism 30, the lower end portion 31*b* and the upper end portion 21*a*, which face each other with the valve body 40 located in between in the up and down directions, constitute, respectively, an upper facing portion and an lower facing portion.

Furthermore, the male-threaded portion 31*e* of the upper holder 31 has the same structure as that of the male-threaded portion 21*e* of the main fuel jet 21. With this configuration, the valve mechanism 30 is also provided to an existing carburetor which has neither the valve holder H nor the valve body 40, that is, no valve mechanism 30, and in which the needle jet 20 and the main fuel jet 21 are directly screwed together.

The valve body 40 is a member which has a roughly circular shape, and which is made of a synthetic resin. The center portion of the valve body 40 constitutes a blockage portion 40*c*. When the valve body 40 is seated on the protrusion 37, or on the upper end portion 21*a*, the blockage portion 40*c* blocks the fuel flowing though the valve body 40, while the fuel is allowed to pass through a fuel entrance 41 formed in the valve body 40. At least one opening, formed near the perimeter of the valve body 40 constitutes the fuel entrance 41. Three cutaways 40*a*, which are formed in an outer peripheral portion of the valve body 40, and which are located equidistantly in the circumferential direction, correspond to the fuel entrance in this embodiment.

Flared portions 40*b* are formed in the valve body 40 by the formation of the cutaways 40*a*. When the valve body 40 is placed in the fuel retention chamber 33, the flared portions 40*b* are brought into contact with the inner peripheral surface of the lower holder 32. Thus, the movement of the valve body 40 in the radial direction of the two valve passages 34 and 35 is restricted. Thanks to the lower holder 32, the blockage portion 40*c* is seated, without failure, on the protrusion 37 to allow the fuel flow, while the blockage portion 40*c* is seated, without failure, on the upper end portion 21*a* to block the reverse flow of the fuel-in-jet.

In addition, the fuel retention chamber 33 has an annular chamber 33*a*, formed by the lower holder 32 and the upper holder 31 and surrounding the lower end portion 31*b*. The width of each fuel entrance 34*a* in the up and down directions is approximately equal to the width of the annular chamber 33*a* in the up and down directions. The fuel in the fuel retention chamber 33, mostly, passes through the annular chamber 33*a*, and then enters, through the fuel entrances 34*a*, the over-valve passage 34. After that, the fuel flows into the needle jet 20.

In the carburetor C with a configuration described above, the fuel having flown out of the float chamber 10 and through the main fuel jet 21, is then supplied from the needle jet 20 to the air intake tube 6. Incidentally, the fuel flows out of the float chamber 10, then passes through the main fuel jet 21 and the fuel retention chamber 33, and then flows into the needle jet 20. When the fuel is supplied to the air intake tube 6, the fuel thus flowing moves the valve body 40. The valve body 40 is seated on the protrusion 37 (see FIG. 2A), and the valve mechanism 30 becomes an open-valve state. At this time, the fuel that flows into the fuel retention chamber 33 from the main fuel jet 21 flows into the annular chamber 33*a* through the fuel entrance 41 of the valve body 40. Then, the fuel flows into the needle jet 20 through the fuel entrances 34*a* and the over-valve passage 34. After the fuel is metered by the jet needle 5, the fuel is supplied to the air intake tube 6 through the upper end portion 20*a*.

On the other hand, when downward acceleration acts on the fuel-in-jet, the downward acceleration forces the fuel-in-jet to flow slightly downward, and the fuel-in-jet moves the valve body 40 until the valve body 40 is seated on the upper end portion 21*a* to block the under-valve passage 35 (see FIG. 2B). Thus, the valve-mechanism 30 becomes a closed-valve state. In this closed-valve state, the valve mechanism 30 blocks the communication of the fuel passage 25, the over-valve passage 34 and the fuel retention chamber 33 with the under-valve passage 35 and the float chamber 10. As a result, the downward reverse flow of the fuel-in-jet is prevented from occurring.

As seen from above, the valve mechanism 30 constitutes a check valve. The check valve allows the flow of the fuel, which enables the supplying of the fuel from the float chamber 10 to the air intake tube 6, while the reverse flow of the fuel-in-jet is blocked by the check valve.

While the valve body 40 is seated on the upper end portion 21*a*, the fuel that is flown out of the fuel retention chamber 33 flows, through the fuel entrances 34*a* and the over-valve passage 34, into the needle jet 20. Then, the fuel is metered by the jet needle 5, and thereafter, is supplied to the air intake tube 6. The air-fuel mixture is thus prevented from becoming lean. At this time, since the fuel retention chamber 33 has the annular chamber 33*a*, extra fuel—precisely, the amount equivalent to the capacity of the annular chamber 33*a*—is retained in the fuel retention chamber 33. Consequently, even when the valve mechanism 30 is in the closed-valve state, the amount of fuel that exists in the fuel retention chamber 33 is sufficient. As a result, a shortage of fuel, which may possibly take place when the valve mechanism 30 is in the closed-valve state, is prevented without failure. The fuel in the fuel retention chamber 33 is then supplied, with no interruption, to the needle jet 20 through the fuel entrances 34*a*, each of which has a width in the up and down directions being approximately equal to that of the annular chamber 33*a*.

Subsequently, description will be given of advantages and effects of the embodiment with a configuration described thus far.

The carburetor C equipped with the needle jet 20, into which the jet needle 5 is inserted, is provided to an internal combustion engine. A motorcycle equipped with such an internal combustion engine including the carburetor C jumps while running and lands on the ground. At that moment, downward acceleration acts on the fuel-in-jet. Since the valve-mechanism 30 is provided to the carburetor C to prevent the downward reverse flow of the fuel-in-jet, the valve mechanism 30 actually prevents the downward reverse flow of the fuel-in-jet, which may possibly be caused by the downward acceleration acting on the fuel-in-jet. As a result, even under the downward acceleration, the fuel-in-jet is supplied to the air intake tube 6, and the production of a lean air-fuel mixture that may possibly be produced temporarily is prevented.

The valve mechanism 30 includes the valve body 40, which has a plate-like shape moved by the flow of the fuel. The valve mechanism 30 also includes the upper holder 31, which serves as an upper valve seat disposed immediately above the valve body 40, and in which the protrusion 37 is formed to allow the valve body 40 to be seated thereon. The valve mechanism 30 also includes the main fuel jet 21, which serves as a lower valve seat disposed immediately below the valve body 40 and on which the valve body 40 can be seated. When the fuel is supplied from the float chamber 10 to the air intake tube 6, the valve body 40 is seated on the protrusion 37 to prevent the adherence of the valve body 40 to the upper holder 31. When downward acceleration acts on the fuel-in-jet, the valve body 40 is seated on the main fuel jet 21 to prevent the downward reverse flow of the fuel-in-jet. The plate-like shape of the valve body 40 facilitates the movement of the valve body 40 caused by the flow of the fuel. Accordingly, a subtle downward flow of the fuel-in-jet, which takes place when the downward acceleration acts on the fuel-in-jet, causes the valve body 40 to be seated on the main fuel jet 21. In addition, the valve body 40 has such a structure including the protrusion 37 that the valve body 40 and the upper holder 31 cannot adhere to each other so easily. As a result, the reverse flow of the fuel-in-jet is prevented quickly, while the valve mechanism 30 prevents, more effectively, the air-fuel mixture from being lean.

The upper holder 31, the lower holder 32 and the main fuel jet 21 form the fuel retention chamber 33, in which the valve body 40 is housed. The fuel retention chamber 33 has the annular chamber 33*a* surrounding the lower end portion 31*b* of the upper holder 31. Accordingly, the fuel retention chamber 33 retains an extra amount of fuel—the amount equivalent to the capacity of the annular chamber 33*a*. While the valve body 40 is seated on the main fuel jet 21, the valve mechanism 30 is in the closed-valve state. Even in the case of the closed-valve state continuing for a little longer time, the fuel in the fuel retention chamber 33 is supplied to the needle jet 20. As a result, no fuel shortage occurs even when the valve mechanism 30 is in the closed-valve state. Thus, the valve mechanism 30 prevents, more effectively, the air-fuel mixture from being lean.

The upper holder 31 of the valve holder H is screwed into and is fixed to the needle jet 20, while the male-threaded portion 31*e* of the upper holder 31 and the male-threaded portion 21*e* of the main fuel jet 21 have the same structures. Accordingly, to an existing carburetor in which the needle jet 20 is screwed to be fixed to the main fuel jet 21, the valve mechanism 30 can be added by screwing to fix the upper holder 31 to the needle jet 20. As a result, existing carburetors can be used for the present invention.

Next, a second embodiment of the present invention will be described by referring to FIG. 4. The second embodiment differs from the first embodiment in that a lower holder 32 constitutes a lower valve seat of a valve mechanism 30. The rest of the configuration of the second embodiment is basically the same as that of the first embodiment. For this reason, descriptions for the same parts will be omitted or simplified, and concentrated on the differences. When members of the second embodiment are the same as, or correspond to, those of the first embodiment, the same or corresponding reference numerals are used when necessary.

The valve mechanism 30 includes a valve body 40 and a valve holder H to which a needle jet 20 is joined. A jet needle 5 is inserted into the needle jet 20. An upper holder 31 and the lower holder 32 constitute the valve holder H.

An under-valve passage 35 is formed in the lower holder 32 in a position further upstream of the fuel flow than the valve body 40 at the time when the valve body 40 is in the closed-valve state. A female-threaded portion 32*c* screwed onto a male-threaded part 31*c* of the upper holder 31 is formed in an upper end portion 32*a* while a female-threaded portion 32*e* screwed onto a male-threaded portion 21*e* of a main fuel jet 21 is formed in an lower end portion 32*b*. A close-valve seat portion 32*s* on which the valve body 40 can be seated is formed between the upper end portion 32*a* and the lower end portion 32*b*.

As seen from the above, the upper holder 31 and the lower holder 32 constitute the upper valve seat and the lower valve seat, respectively. The upper holder 31 and the lower holder 32 are joined together to form a space. Part of the space located on the further downstream side of the fuel flow than the valve body 40 positioned at the time when the valve mechanism 30 is in the closed-valve state constitutes a fuel retention chamber 33. A lower end portion 31*b* and the seat portion 32*s* constitute an upper facing portion and a lower facing portion, respectively. The upper and the lower facing portions face each other with the valve body 40 in between in the up and down directions.

When the fuel is supplied from a float chamber 10 to an air intake tube 6 (see FIG. 1), the flow of the fuel that flows, out of the float chamber 10, through a main fuel jet 21 and a fuel retention chamber 33, and then into a needle jet 20 moves the valve body 40. The valve body 40 is seated on a protrusion 37, and the valve mechanism 30 becomes an open-valve state. At this time, the fuel that flows into the fuel retention chamber 33 from the main fuel jet 21 flows into an annular chamber 33*a* through a fuel entrance 41 of the valve body 40. Then, the fuel flows into the needle jet 20 through fuel entrances 34*a* and an over-valve passage 34. After the fuel is metered by a jet needle 5, the fuel is supplied to the air intake tube 6 through an upper end portion 20*a* (see FIG. 1).

Figure 4:
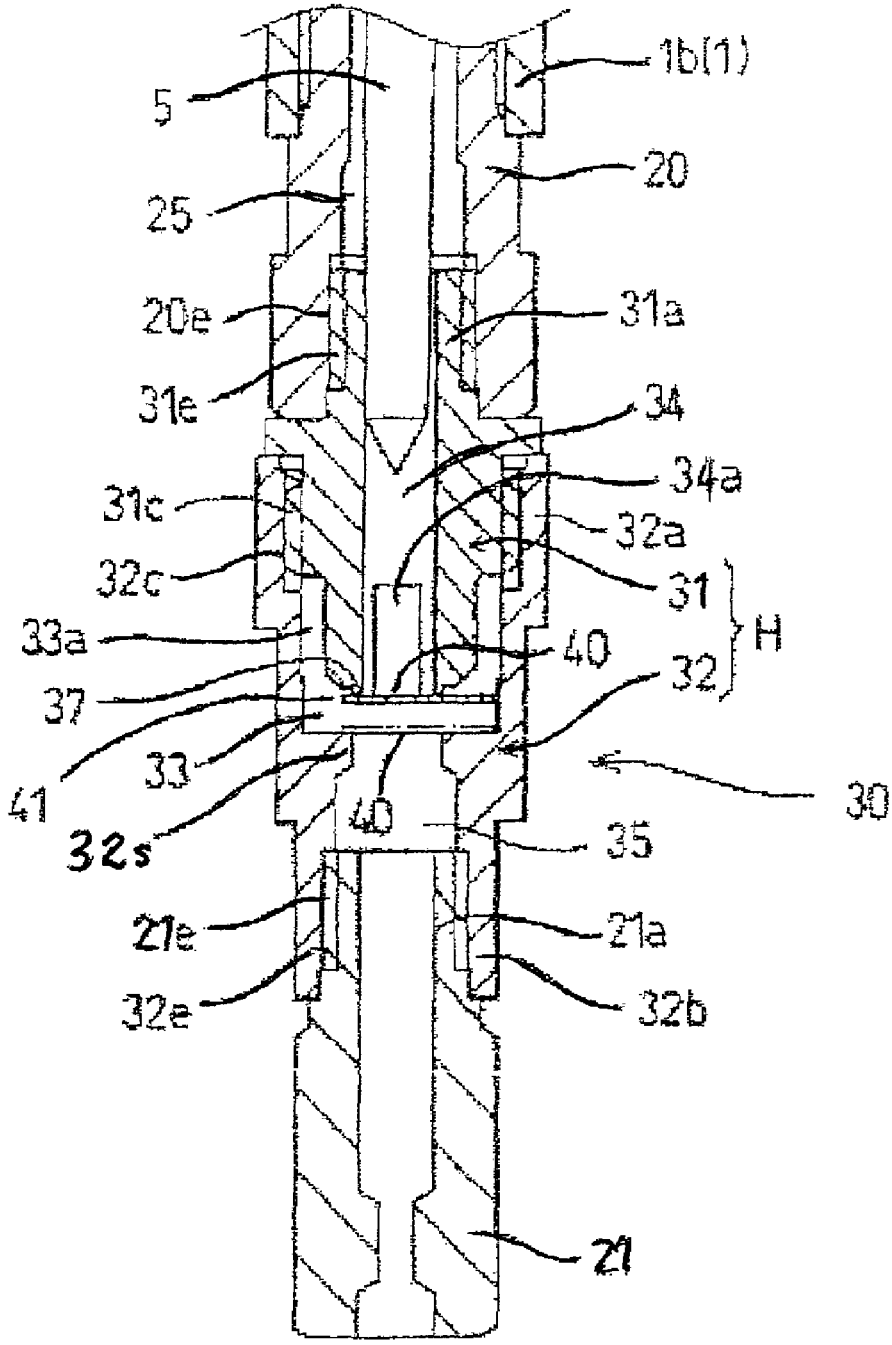
FIG. 4 is a cross-sectional view according to a second embodiment of the present invention, and the view corresponds to an enlarged view of the main part of FIG. 1.

On the other hand, when downward acceleration acts on the fuel-in-jet, the downward acceleration forces the fuel-in-jet to flow slightly downward, and the fuel-in-jet moves the valve body 40 until the valve body 40 is seated on the seat portion 32*s* to block the under-valve passage 35 (as indicated by a two-dot chain line in FIG. 4). Thus blocked is the communication of a fuel passage 25, the over-valve passage 34 and the fuel retention chamber 33 with the under-valve passage 35, the main fuel jet 21 and the float chamber 10. As a result, the downward reverse flow of the fuel-in-jet is prevented from occurring.

According to the second embodiment, the same advantages and effects can be obtained as those obtained according to the first embodiment.

Hereinbelow, a description will be given of the combination of elements illustrated if FIG. 4, in which a part of configurations of the embodiments described above is modified. The description will be given of the part of the configuration that is modified.

In a valve mechanism 30, a valve holder H may be attached to a needle jet 20, and the needle jet 20 may constitute an upper valve seat 31.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A carburetor in which a needle jet is disposed as extending in an up and down direction, fuel in a fuel chamber is supplied to an air intake tube through an upper end portion of the needle jet, a throttle valve is disposed in the air intake tube, a jet needle provided to the throttle valve is inserted into the needle jet, and an amount of the fuel to be supplied to the air intake tube is controlled by the jet needle working in conjunction with an opening-and-closing action of the throttle valve, the carburetor comprising:

a valve mechanism adapted to prevent a downward reverse flow of fuel-in-jet, which is the reverse flow of the fuel in the needle jet caused by a downward acceleration acting on the fuel-in-jet.

2. The carburetor as recited in claim 1, wherein the valve mechanism includes:

a plate-shaped valve body adapted to be moved by a flow of the fuel, an upper valve seat disposed immediately above the valve body and provided with a protrusion on which the valve body can be seated, and a lower valve seat which is disposed immediately below the valve body and on which the valve body can be seated;

wherein the valve body is seated on the protrusion to prevent the valve body from adhering to the upper valve seat when the fuel is supplied from the fuel chamber to the air intake tube; and the valve body is seated on the lower valve seat when the acceleration acts on the fuel-in-jet, and the valve body prevents the downward reverse flow of the fuel-in-jet.

3. The carburetor as recited in claim 2, wherein the upper valve seat and the lower valve seat form a fuel retention chamber in which the valve body is housed; and the fuel retention chamber includes an annular chamber surrounding the upper valve seat.

4. The carburetor as recited in claim 1, wherein the valve mechanism includes:

a valve holder having a screw-fixation portion adapted to fixedly screw the valve holder to the needle jet;

a main fuel jet having a screw-fixation portion adapted to fixedly screw the main fuel jet to the valve holder, the screw-fixation portions of the valve holder and the main fuel jet having structures that are equivalent.

5. The carburetor as recited in claim 2, wherein the valve body includes three cutaways which are formed in an outer peripheral portion of the valve body, and which are located equidistantly in a circumferential direction, the three cutaways correspond to fuel entrances.

6. The carburetor as recited in claim 3, wherein the valve body includes three cutaways which are formed in an outer peripheral portion of the valve body, and which are located equidistantly in a circumferential direction, the three cutaways correspond to fuel entrances.

7. The carburetor as recited in claim 6, wherein the valve body includes flared portions between the cutaway portions, and when the valve body is placed in the fuel retention chamber, the flared portion are brought into contact with an inner peripheral portion of a lower holder.

8. The carburetor as recited in claim 1, wherein the valve mechanism includes an upper holder, a lower holder, and a main fuel jet, the upper holder and the main fuel jet adapted to be fixedly screwed into opposite ends of the lower holder.

9. The carburetor as recited in claim 4, wherein the valve holder includes an upper holder, a lower holder, and a plate-shaped valve body;

wherein the upper holder and the main fuel jet are adapted to be fixedly screwed into opposite ends of the lower holder.

10. The carburetor as recited in claim 9, wherein the upper holder and the lower holder form a fuel retention chamber in which the valve body is housed and is moved up and down by a flow of the fuel; and the fuel retention chamber includes an annular chamber between an lower end portion of the upper holder and an inner peripheral surface of the lower body.

11. The carburetor as recited in claim 2, wherein the protrusion has a width t in a radial direction that is approximately equal to a thickness of the valve body.

12. The carburetor as recited in claim 9, wherein the upper holder is formed with a ring-shaped protrusion, the ring-shaped protrusion having a width t in a radial direction that is approximately equal to a thickness of the valve body.

13. A fuel system, comprising:

an air intake tube;

a throttle valve disposed in the air intake tube;

a carburetor, the carburetor including:

a needle jet extending in an up and down direction below the throttle valve;

a jet needle provided to the throttle valve inserted into the needle jet, a fuel chamber adapted to supply fuel to the air intake tube through an upper end portion of the needle jet; and a valve mechanism adapted to prevent a downward reverse flow of fuel-in-jet, which is the reverse flow of the fuel in the needle jet caused by a downward acceleration acting on the fuel-in-jet, wherein an amount of the fuel to be supplied to the air intake tube is controlled by the jet needle working in conjunction with an opening-and-closing action of the throttle valve.

14. The fuel system as recited in claim 13, wherein the valve mechanism includes:

a plate-shaped valve body adapted to be moved by a flow of the fuel, an upper valve seat disposed immediately above the valve body and provided with a protrusion on which the valve body can be seated, and a lower valve seat which is disposed immediately below the valve body and on which the valve body can be seated;

wherein the valve body is seated on the protrusion to prevent the valve body from adhering to the upper valve seat when the fuel is supplied from the fuel chamber to the air intake tube; and the valve body is seated on the lower valve seat when the acceleration acts on the fuel-in-jet, and the valve body prevents the downward reverse flow of the fuel-in-jet.

15. The fuel system as recited in claim 14, wherein the upper valve seat and the lower valve seat form a fuel retention chamber in which the valve body is housed; and the fuel retention chamber includes an annular chamber surrounding the upper valve seat.

16. The fuel system as recited in claim 13, wherein the valve mechanism includes:

a valve holder having a screw-fixation portion adapted to fixedly screw the valve holder to the needle jet;

a main fuel jet having a screw-fixation portion adapted to fixedly screw the main fuel jet to the valve holder, the screw-fixation portions of the valve holder and the main fuel jet having structures that are equivalent.

17. A carburetor, comprising:

a needle jet extending in an up and down direction, a fuel chamber for supplying fuel to an air intake tube through an upper end portion of the needle jet, a sliding throttle valve capable of a reciprocating up and down for opening and closing the air intake tube, a jet needle provided to the throttle valve and inserted into the needle jet; and a valve mechanism adapted to prevent a downward reverse flow of fuel-in-jet, which is the reverse flow of the fuel in the needle jet caused by a downward acceleration acting on the fuel-in-jet, wherein an amount of the fuel to be supplied to the air intake tube is controlled by the jet needle working in conjunction with an opening-and-closing action of the throttle valve.

18. The carburetor as recited in claim 17, wherein the valve mechanism includes:

a plate-shaped valve body adapted to be moved by a flow of the fuel, an upper valve seat disposed immediately above the valve body and provided with a protrusion on which the valve body can be seated, and a lower valve seat which is disposed immediately below the valve body and on which the valve body can be seated;

wherein the valve body is seated on the protrusion to prevent the valve body from adhering to the upper valve seat when the fuel is supplied from the fuel chamber to the air intake tube; and the valve body is seated on the lower valve seat when the acceleration acts on the fuel-in-jet, and the valve body prevents the downward reverse flow of the fuel-in-jet.

19. The carburetor as recited in claim 18, wherein the upper valve seat and the lower valve seat form a fuel retention chamber in which the valve body is housed; and the fuel retention chamber includes an annular chamber surrounding the upper valve seat.

20. The carburetor as recited in claim 17, wherein the valve mechanism includes:

a valve holder having a screw-fixation portion adapted to fixedly screw the valve holder to the needle jet;

a main fuel jet having a screw-fixation portion adapted to fixedly screw the main fuel jet to the valve holder, the screw-fixation portions of the valve holder and the main fuel jet having structures that are equivalent.

* * * * *